US008480375B2

(12) United States Patent
Tsai

(10) Patent No.: US 8,480,375 B2
(45) Date of Patent: Jul. 9, 2013

(54) AUTO-STOP AIR PUMP

(75) Inventor: Chun-Chung Tsai, Dongguan (CN)

(73) Assignee: Dongguan Tiger Point, Metal & Plastic Products Co., Ltd., Dongguan (CN)

( * ) Notice: Subject to any disclaimer, the term of this patent is extended or adjusted under 35 U.S.C. 154(b) by 324 days.

(21) Appl. No.: 12/906,346

(22) Filed: Oct. 18, 2010

(65) Prior Publication Data

US 2012/0093662 A1 Apr. 19, 2012

(51) Int. Cl.
*F04B 49/08* (2006.01)
*F04B 39/14* (2006.01)

(52) U.S. Cl.
USPC ..... 417/44.9; 417/239; 417/371; 417/423.14

(58) Field of Classification Search
USPC ..... 417/44.9, 44.3, 44.2, 423.14, 17, 417/238, 239, 370, 371; 5/423, 704, 708, 5/713, 726; 141/10, 67, 95, 197
See application file for complete search history.

(56) References Cited

U.S. PATENT DOCUMENTS

| | | | | |
|---|---|---|---|---|
| 2,160,278 | A * | 5/1939 | Ness et al. | 417/371 |
| 6,237,653 | B1 * | 5/2001 | Chaffee | 141/313 |
| 7,475,443 | B2 * | 1/2009 | Wang | 5/713 |
| 7,588,425 | B2 * | 9/2009 | Chung | 417/315 |
| 8,033,797 | B2 * | 10/2011 | Kehrmann et al. | 417/44.9 |
| 8,147,216 | B2 * | 4/2012 | Schiffhauer et al. | 417/371 |
| 2010/0014993 | A1 * | 1/2010 | Wang et al. | 417/315 |
| 2010/0247337 | A1 * | 9/2010 | Tsai | 417/239 |
| 2012/0093662 | A1 * | 4/2012 | Tsai | 417/44.2 |
| 2012/0107157 | A1 * | 5/2012 | Tsai | 417/423.14 |

* cited by examiner

*Primary Examiner* — Devon Kramer
*Assistant Examiner* — Bryan Lettman
(74) *Attorney, Agent, or Firm* — C. G. Mersereau; Nikolai & Mersereau, P.A.

(57) ABSTRACT

An auto-stop air pump has a housing, a blower and an auto-stop device. The housing has an upper chamber, a lower chamber, a main inlet and an outlet. The upper chamber and the lower chamber communicate with each other. The main inlet and the outlet are formed through the housing respectively and communicate with the upper chamber. The blower is mounted in the housing and has a motor connected to a dual-sided impeller. The auto-stop device is mounted in the housing and has a shell, a film, a micro switch and an actuating unit. The film and the micro switch are mounted in the shell. The actuating unit is mounted movably through the shell. Owing to deformation of the film by pressure, the film presses the micro switch to close the micro switch so the air pump can stop working automatically.

13 Claims, 15 Drawing Sheets

AUTO-STOP AIR PUMP

BACKGROUND OF THE INVENTION

1. Field of the Invention

The present invention relates to an air pump, and more particularly to an air pump that can stop automatically when an inflatable article is finished inflating or deflating by the air pump.

2. Description of the Prior Arts

Air pumps are key components of inflatable articles, for instance, air mattresses, inflatable trampolines, inflatable sofas, large-sized inflatable toys or the like. Usually, air pumps are mounted inside the inflatable articles for inflating and deflating inflatable articles and also maintaining the pressure therein, so the inflatable articles are convenient to use and store.

Currently, a conventional air pump has a housing and a blower. The housing has an inlet and an outlet. The blower is mounted inside the housing and has a motor connected to an impeller. In operation, the motor drives the impeller to rotate at a high speed to generate airflow and change pressure inside the housing to achieve the inflating or deflating effect.

However, the conventional air pump still has many problems that need to be solved. Most conventional air pumps do not have auto-stop function so inflating or deflating work must be manually operated. Dependence on manual operation makes the device highly labor-consuming. Some conventional air pumps have auto-stop function, but only during the inflating process. Further, structure of the conventional air pumps with auto-stop function is complex and has many elements. Such structure may raise material costs for production and assembly and lowers productivity. Moreover, the impellers of the conventional air pumps are single-vane impellers so that work efficiency is limited and hard to increase.

To overcome the shortcomings, the present invention provides an auto-stop air pump to mitigate or obviate the aforementioned problems.

SUMMARY OF THE INVENTION

The main object of the present invention is to provide an auto-stop air pump that can stop automatically when inflating or deflating work is finished.

An auto-stop air pump comprises a housing, a blower and an auto-stop device. The housing has an upper chamber, a lower chamber, a main inlet, an outlet, an auxiliary inlet and an air valve. The upper chamber and the lower chamber are defined inside the housing respectively and communicate with each other. The main inlet and the outlet are formed through the housing respectively and communicate with the upper chamber. The auxiliary inlet is formed through the housing and communicates with the lower chamber. The air valve is mounted in the housing and is adjacent to the auxiliary inlet. The blower is mounted in the housing and has a motor connected to a dual-sided impeller. The auto-stop device is mounted in the housing and has a shell, a deformable film, a micro switch and an actuating unit. The shell has a bottom panel, an upper chamber and a lower chamber. The upper chamber communicates with the upper chamber of the housing. The lower chamber communicates with the lower chamber of the housing. The film is mounted in the shell. The micro switch is mounted in the lower chamber of the shell. The actuating unit is mounted movably through the bottom panel of the shell. Owing to deformation of the film by pressure, the film presses the micro switch to close the micro switch so the air pump can stop working automatically. Besides, the dual-sided impeller provides large amount of airflow and initiates high air speed so the operation of the air pump is more efficient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
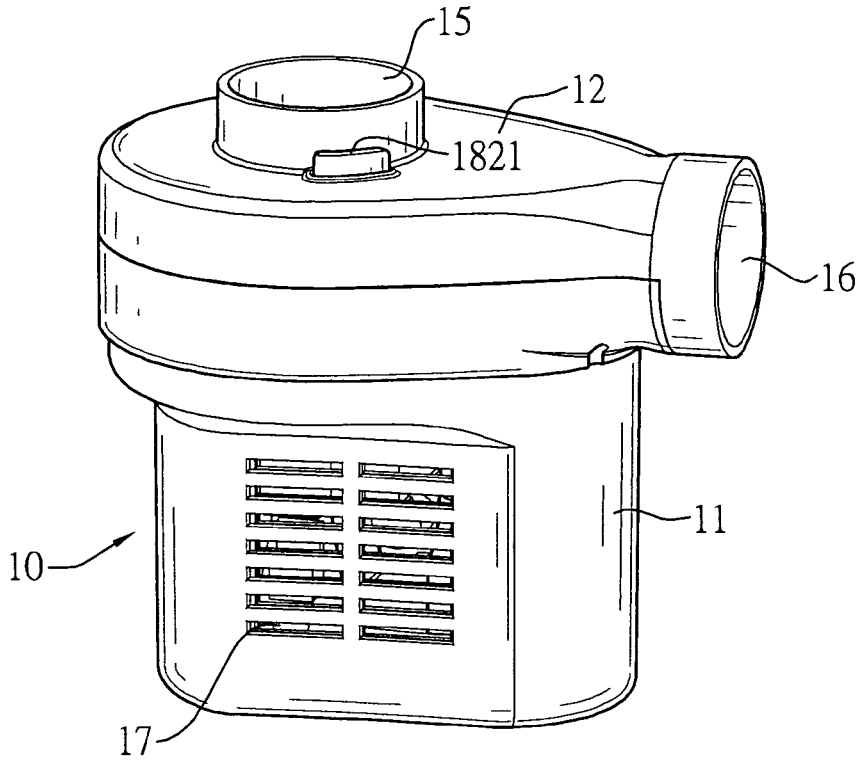
FIG. 1 is a perspective view of an auto-stop air pump in accordance with the present invention.
Figure 2:
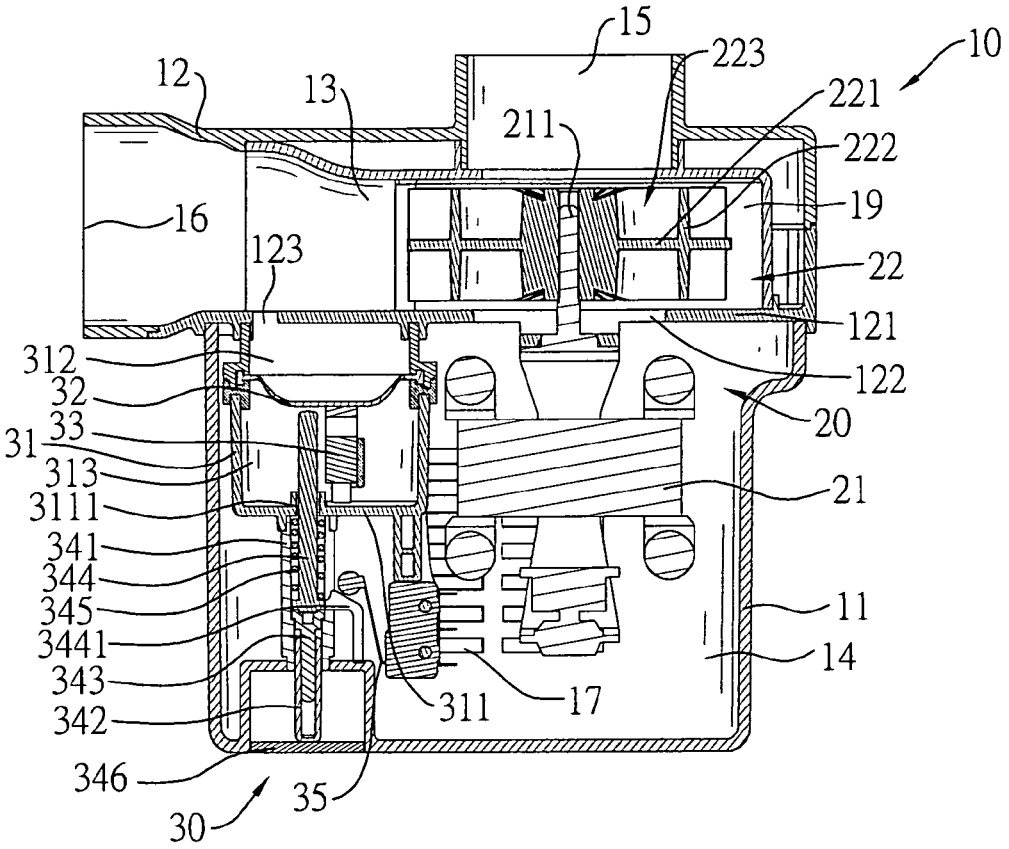
FIG. 2 is a side view in partial section of the auto-stop air pump in FIG. 1.
Figure 3:
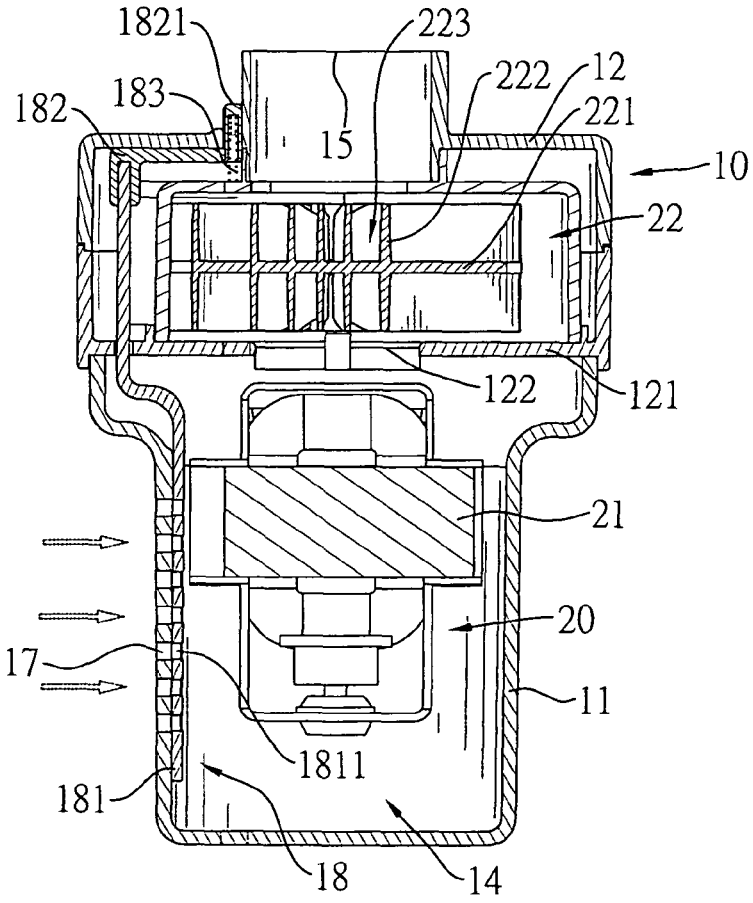
FIG. 3 is a front view in partial section of the auto-stop air pump in FIG. 1.

With reference to FIGS. 1 to 3, an auto-stop air pump in accordance with the present invention comprises a housing 10, a blower 20 and an auto-stop device 30.

The housing 10 has a container 11, a casing 12, an upper chamber 13, a lower chamber 14, a main inlet 15, an outlet 16, an auxiliary inlet 17 and an air valve 18. The casing 12 covers the container 11 and has a bottom board 121, a communicating hole 122 and an aperture 123. The communicating hole 122 and the aperture 123 are formed through the bottom board 121 of the casing 12 respectively. The upper chamber 13 is defined inside the casing 12. The lower chamber 14 is defined in the container 11. The upper chamber 13 and the lower chamber 14 communicate with each other via the communicating hole 122 of the casing 12. The main inlet 15 and the outlet 16 are formed through the casing 12 of the housing 10 respectively and communicate with the upper chamber 13. The main inlet 15 and the outlet 16 may be tubes protruding from the casing 12. The auxiliary inlet 17 is formed through the container 11 and communicates with the lower chamber 14. The auxiliary inlet 17 may comprise multiple slots. With reference to FIG. 3, the air valve 18 is mounted in the housing 10 and is adjacent to the auxiliary inlet 17 and has a moving board 181, a pressing part 182 and a return spring 183. The moving board 181 has a top end and an air vent 1811 aligning with the auxiliary inlet 17. The pressing part 182 is attached to the top end of the moving board 181 and has a top end 1821. The top end 1821 of the pressing part 182 protrudes out of the housing 10 and is adjacent to the main inlet 15 of the housing 10. The return spring 183 is mounted under the pressing part 182 and abuts the pressing part 182.

Figure 4:
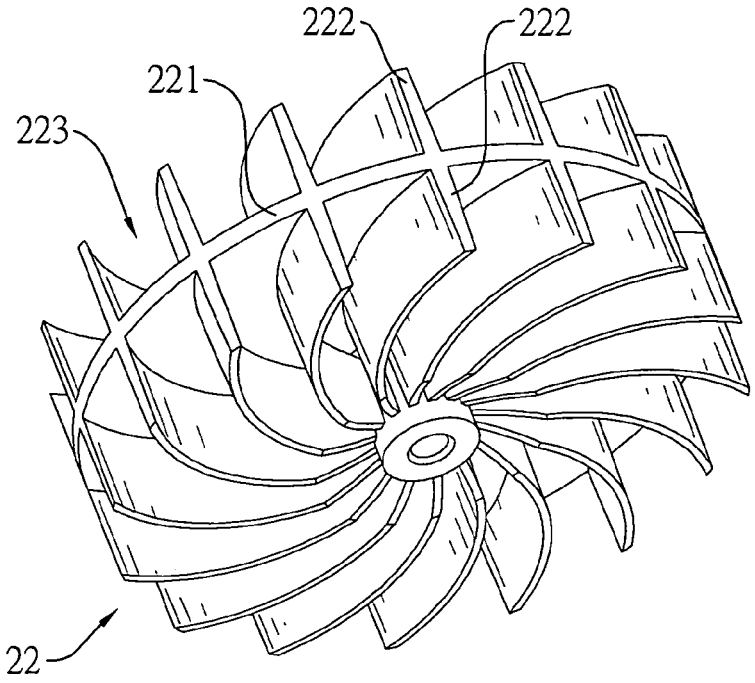
FIG. 4 is a perspective view of a dual-sided impeller of the auto-stop air pump in FIG. 1.

The blower 20 is mounted in the housing 10 and has a motor 21 and a dual-sided impeller 22. The motor 21 is mounted in the lower chamber 14 of the housing 10 and has a shaft 211. With further reference to FIG. 4, the dual-sided impeller 22 is mounted in the upper chamber 13 of the housing 10, is mounted securely around the shaft 211 of the motor 21 and has a panel 221, multiple blades 222, multiple diversion trenches 223, a top side, a bottom side and an annular side. The panel 221 is mounted securely on the shaft 211 of the motor 21. The blades 222 are formed perpendicularly on two opposite side surfaces of the panel 221. Each diversion trench 223 is defined between the two adjacent blades 222. The top side of the dual-sided impeller 22 faces and corresponds to the main inlet 15 of the housing 10. The bottom side of the dual-sided impeller 22 faces and corresponds to the communicating hole 122 of the housing 10. The annular side faces and corresponds to the outlet 16 of the housing 10. The housing 10 further has an annular channel 19 defined around the dual-sided impeller 22 and communicating with the main inlet 15 and the communicating hole 122 of the housing 10 as shown in FIG. 2.

Figure 5:
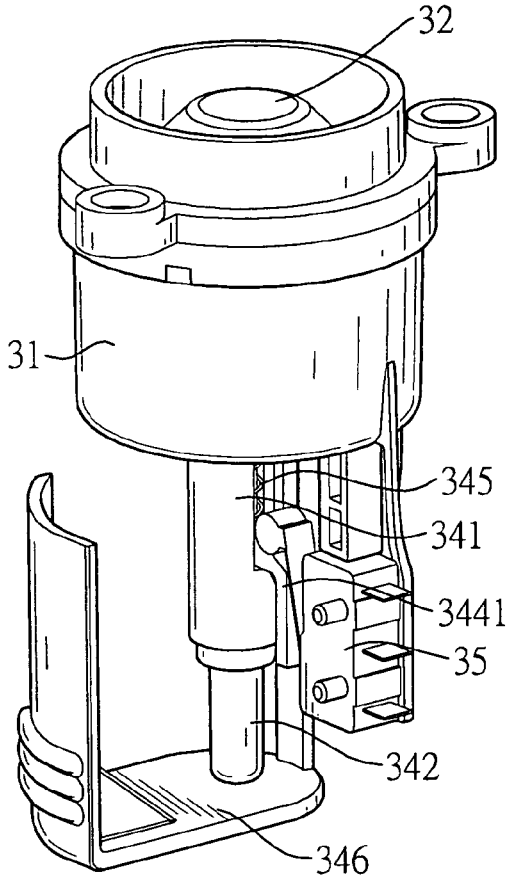
FIG. 5 is an enlarged perspective view of an auto-stop device of the auto-stop air pump in FIG. 1.
Figure 6:
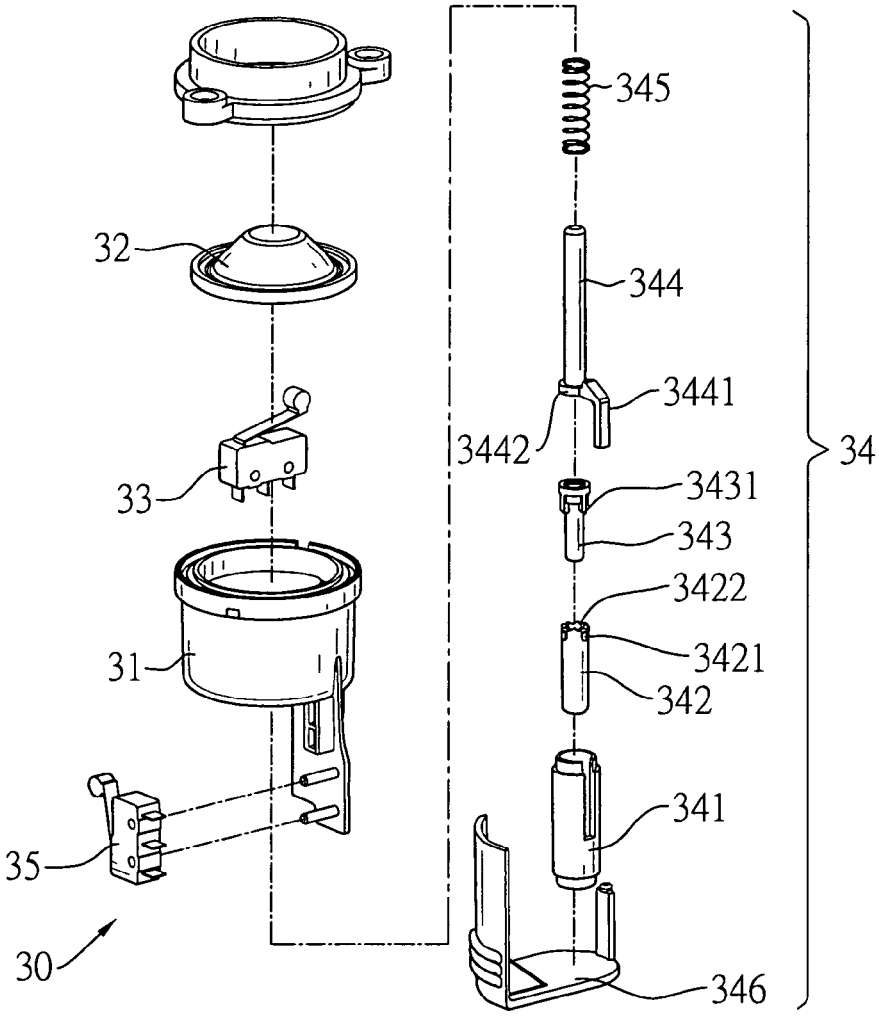
FIG. 6 is an enlarged exploded perspective view of the auto-stop device of the auto-stop air pump in FIG. 1.

With reference to FIGS. 2, 5 and 6, the auto-stop device 30 is mounted in the housing 10 and has a shell 31, a deformable film 32, a micro switch 33, an actuating unit 34 and a master switch 35. The shell 31 has a bottom panel 311, an upper chamber 312 and a lower chamber 313. The bottom panel 311 has an orifice 3111. The upper chamber 312 communicates with the upper chamber 13 and the outlet 16 of the housing 10 via the aperture 123 of the housing 10. The lower chamber 313 communicates with the lower chamber 14 of the housing 10 via the orifice 3111 of the bottom panel 311. The film 32 is mounted in the shell 31 and separates the upper chamber 312 and the lower chamber 313. The micro switch 33 is mounted in the lower chamber 313 of the shell 31, is normally opened and can be pressed by the film 32.

Figure 7:
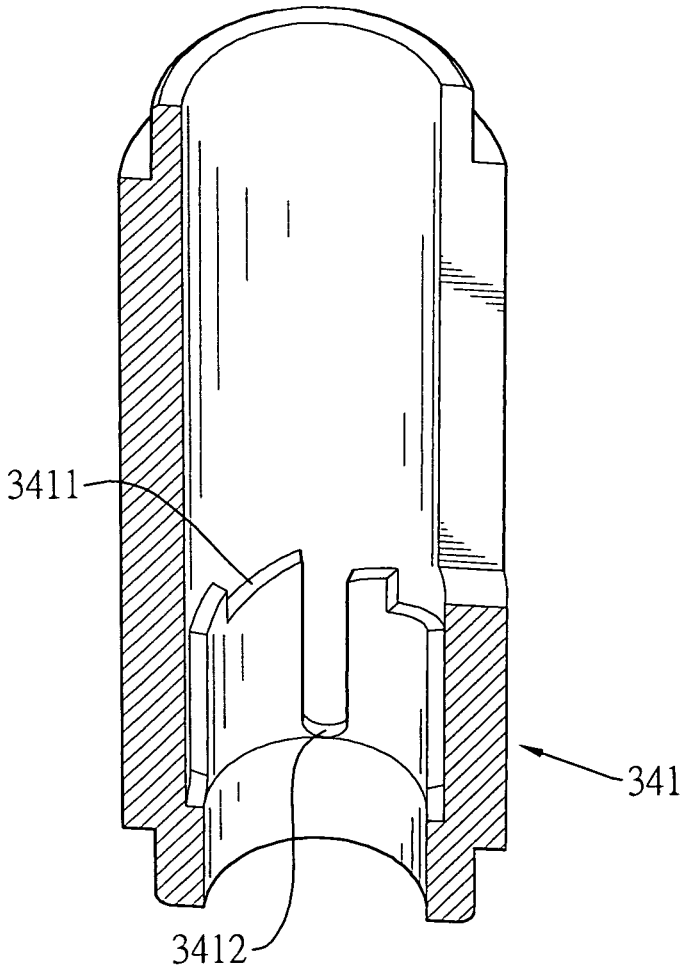
FIG. 7 is an enlarged perspective view in partial section of a sleeve of the auto-stop device of the auto-stop air pump in FIG. 1.

The actuating unit 34 is mounted movably through the bottom panel 311 of the shell 31, is two-step controlled and has a sleeve 341, a sliding part 342, a rotating part 343, an abutting part 344, a pressure spring 345 and a pushing part 346. With further reference to FIG. 7, the sleeve 341 is mounted securely under the bottom panel 311 of the shell 31, corresponds to and aligns with the orifice 3111 of the shell 31 and has an inner surface, multiple ratchets 3411 and multiple tracks 3412. The ratchets 3411 are formed around the inner surface of the sleeve 341. The tracks 3412 are formed separately between the ratchets 3411 of the sleeve 341. The sliding part 342 is mounted movably through the sleeve 341 and has a top end, a bottom end, a top end surface, an outer surface, multiple bosses 3421 and multiple teeth 3422. The bottom end of the sliding part 342 protrudes out of the sleeve 341. The bosses 3421 protrude from and are formed separately around the outer surface and the top end of the sliding part 342 and respectively engage the tracks 3412 of the sleeve 341. The teeth 3422 are formed around the top end surface of the sliding part 342. The rotating part 343 is mounted rotatably through the sleeve 341 and the sliding part 342 and has a top end, an outer surface and multiple ribs 3431. The ribs 3431 protrude from and are formed separately around the outer surface and the top end of the rotating part 343, respectively engage the tracks 3412 of the sleeve 341 and respectively abut the bosses 3421 of the sliding part 342. The abutting part 344 is mounted movably through the sleeve 341 and the orifice 3111 of the shell 31 and has a bottom end, an upper section, a lower section, a block 3441 and an annular flange 3442. The bottom end of the abutting part 344 abuts the rotating part 343. The upper section of the abutting part 344 protrudes through the lower chamber 313 of the shell 31. The block 3441 protrudes from the bottom end of the abutting part 344. The annular flange 3442 is formed around the bottom end of the abutting part 344 and abuts the top end of the rotating part 343. The pressure spring 345 is mounted around the lower section of the abutting part 344 and is mounted in the sleeve 341 and has two ends. One end of the pressure spring 345 abuts the flange 3442 of the abutting part 344. The other end of the pressure spring 345 abuts the bottom panel 311 of the shell 31. The pushing part 346 is mounted under the housing 10 and abuts the bottom end of the sliding part 342.

Figure 8:
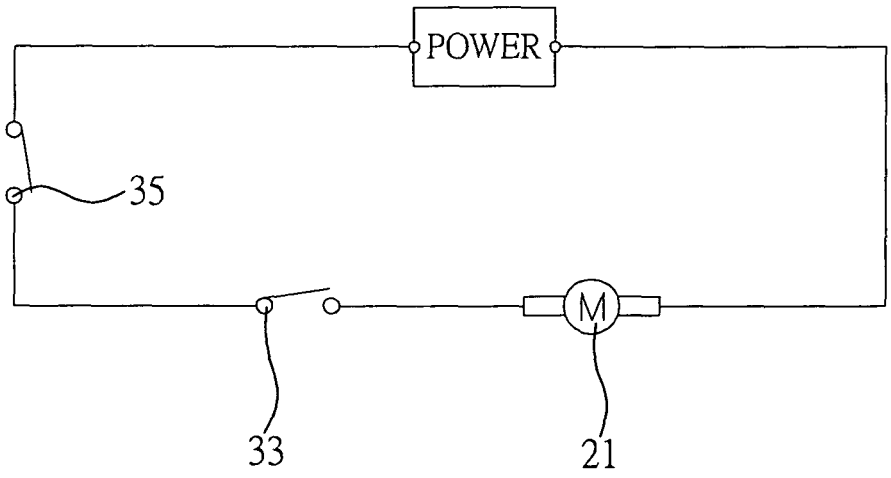
FIG. 8 is a circuit diagram of the auto-stop air pump in FIG. 1.

The master switch 35 is mounted on the shell 31 near the block 3441 of the abutting part 344 and is normally closed. With reference to FIG. 8, the master switch 35 and the micro switch 33 are connected to each other in series.

Figure 9:
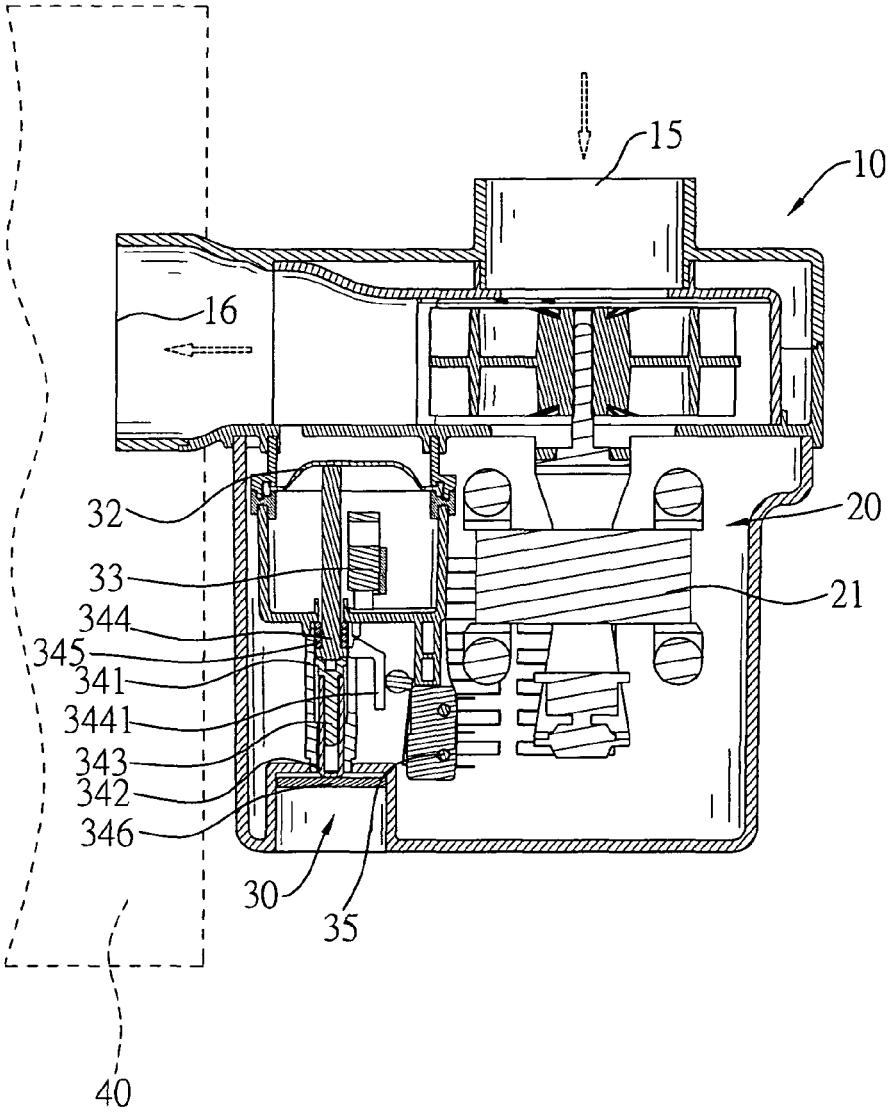
FIG. 9 is an operational side view in partial section of the auto-stop air pump in FIG. 1, showing a pushing part of an actuating unit being pushed.

With reference to FIG. 9, when the air pump is operated for inflating, the main inlet 15 is connected to an air source or the environment and the outlet 16 is connected to the inflatable article 40. The pushing part 346 of the actuating unit 34 is pushed to drive the sliding part 342, the rotating part 343 and the abutting part 344 to move upward and the ribs 3431 of the rotating part 343 are disengaged from the tracks 3412 of the sleeve 341 so the pressure spring 345 is compressed to generate a resilient force. The block 3441 of the abutting part 344 moves upward and abuts the master switch 35 so that the master switch 35 is switched on. The abutting part 344 drives the film 32 to become deformed upward and depart from abutting the micro switch 33 so that the micro switch 33 is switched on.

Figure 10:
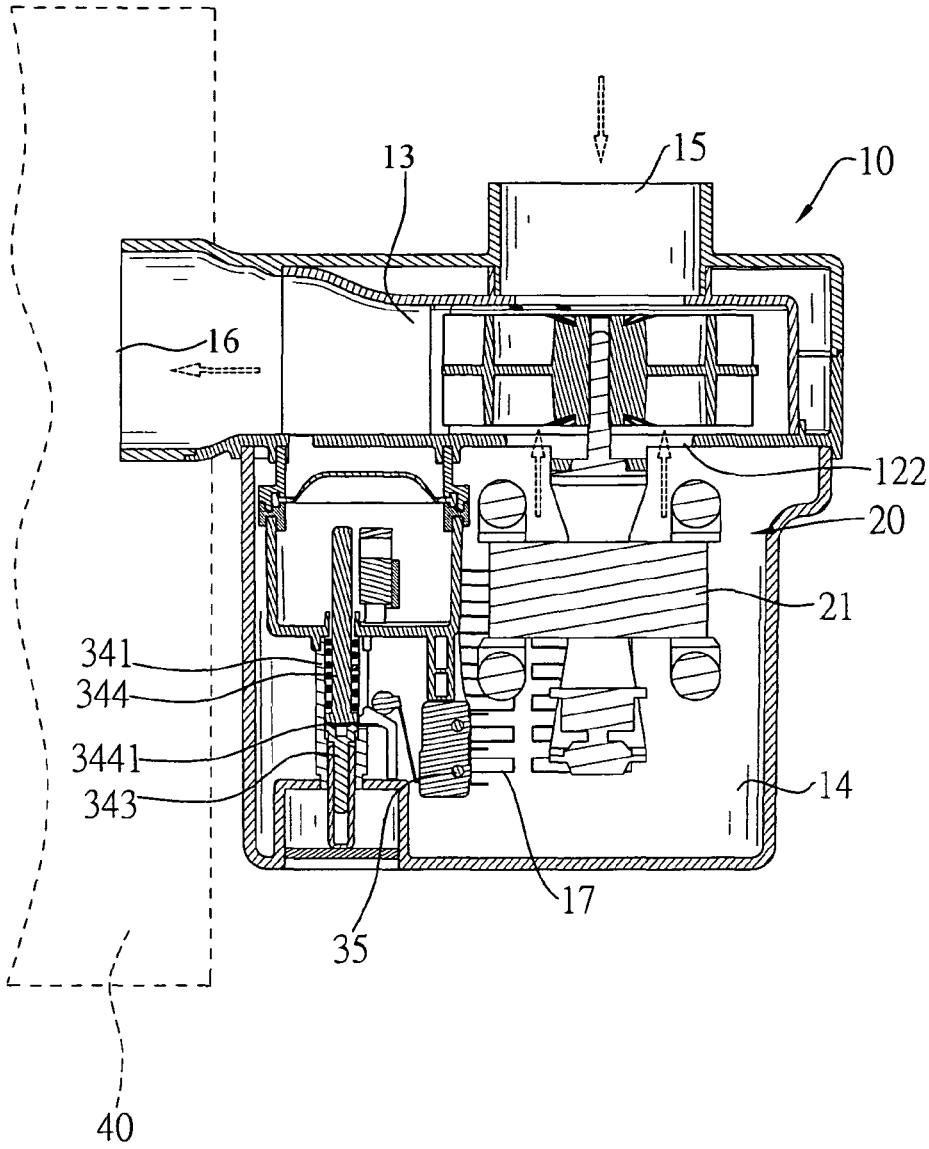
FIG. 10 is an operational side view in partial section of the auto-stop air pump in FIG. 1, showing the pushing part of the actuating unit being released.

With reference to FIG. 10, when the pushing part 346 of the actuating unit 34 is released, the pressure spring 345 provides a resilient force to the abutting part 344 so the abutting part 344 and the rotating part 343 are moved downward. The ribs 3431 of the rotating part 343 reengage the ratchets 3411 of the sleeve 341. At the same time, the block 3441 of the abutting part 344 keeps abutting the master switch 35 to hold the master switch 35 at the opened status. The motor 21 operates because both the master switch 35 and the micro switch 33 are at opened status and drives the dual-sided impeller 22 to rotate at high speed and generate airflow. Air is absorbed to inflate the inflatable article 40 quickly via the main inlet 15, the upper chamber 13 and the outlet 16 in sequence, or via the auxiliary inlet 17, the lower chamber 14, the communicating hole 122, the upper chamber 13 and the outlet 16 in sequence.

Figure 11:
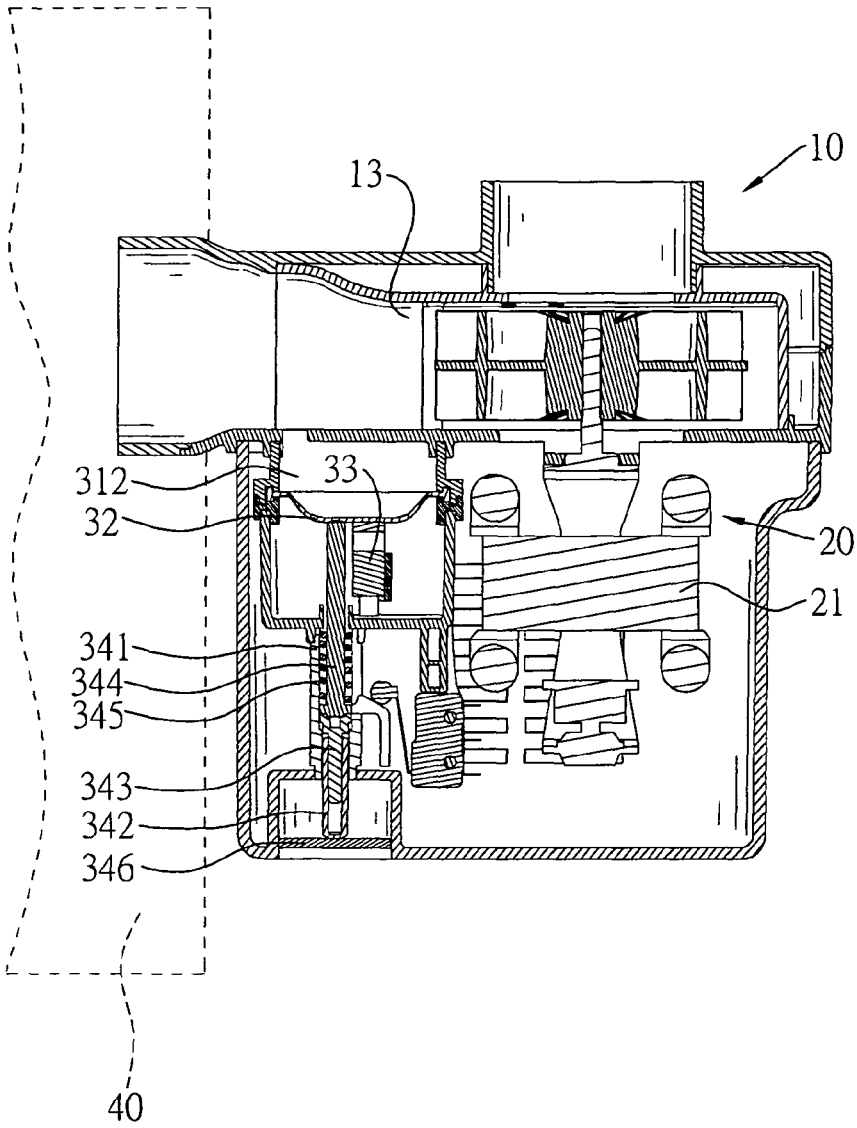
FIG. 11 is an operational side view in partial section of the auto-stop air pump in FIG. 1, showing a film becoming deformed downward in inflating work.

With reference to FIG. 11, when the inflating process is finished, the pressure inside the upper chamber 13 gradually increases so pressure inside the upper chamber 312 of the shell 31 also gradually increases. The film 32 becomes deformed downward by the pressures to abut the micro switch 33 so the micro switch 33 is switched off and the motor 21 stops operating. Thus, the function of auto-stop in inflating work is achieved.

The air pump also can be stopped by manual operation. The pushing part 346 of the actuating unit 34 is pushed again to drive the sliding part 342, the rotating part 343 and the abutting part 344 to move upward so the pressure spring 345 is compressed. When the pushing part 346 of the actuating unit 34 is released, the pressure spring 345 provides resilient force to push the abutting part 344 to move downward and the ribs 3431 of the rotating part 343 to engage the tracks 3412 of the sleeve 341. The block 3441 of the abutting part 344 departs from the position abutting the master switch 35 so the master switch 35 is switched off and the air pump stops operating.

The inflatable article 40 can be inflated compulsively by pulling the pushing part 346 of the actuating unit 34 all along. The film 32 is supported by the abutting part 344 so the film 32 is kept from being deformed to close the micro switch 33. Therefore, hardness of the inflatable article 40 is increased and is adjustable.

Figure 12:
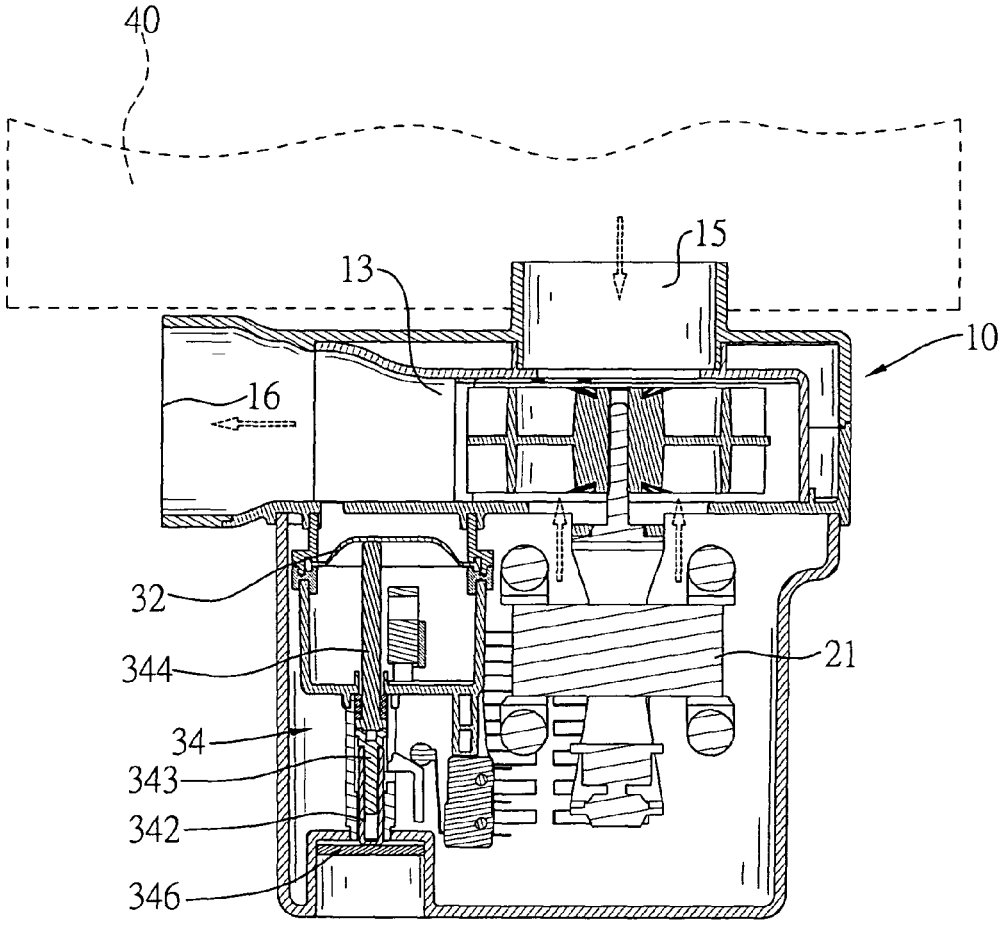
FIG. 12 is an operational side view in partial section of the auto-stop air pump in FIG. 1, showing a deflating work.
Figure 13:
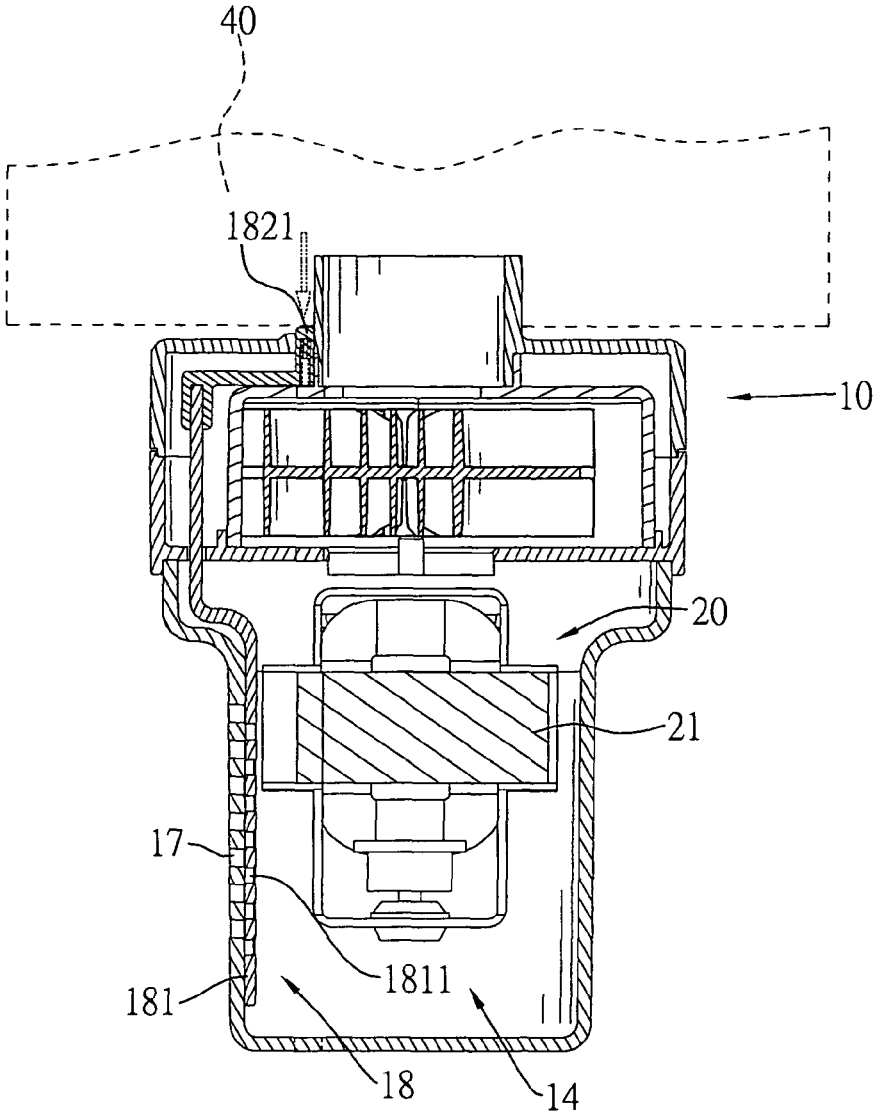
FIG. 13 is an operational front view in partial section of the auto-stop air pump in FIG. 1, showing a pressing part of an air valve being pressed.
Figure 14:
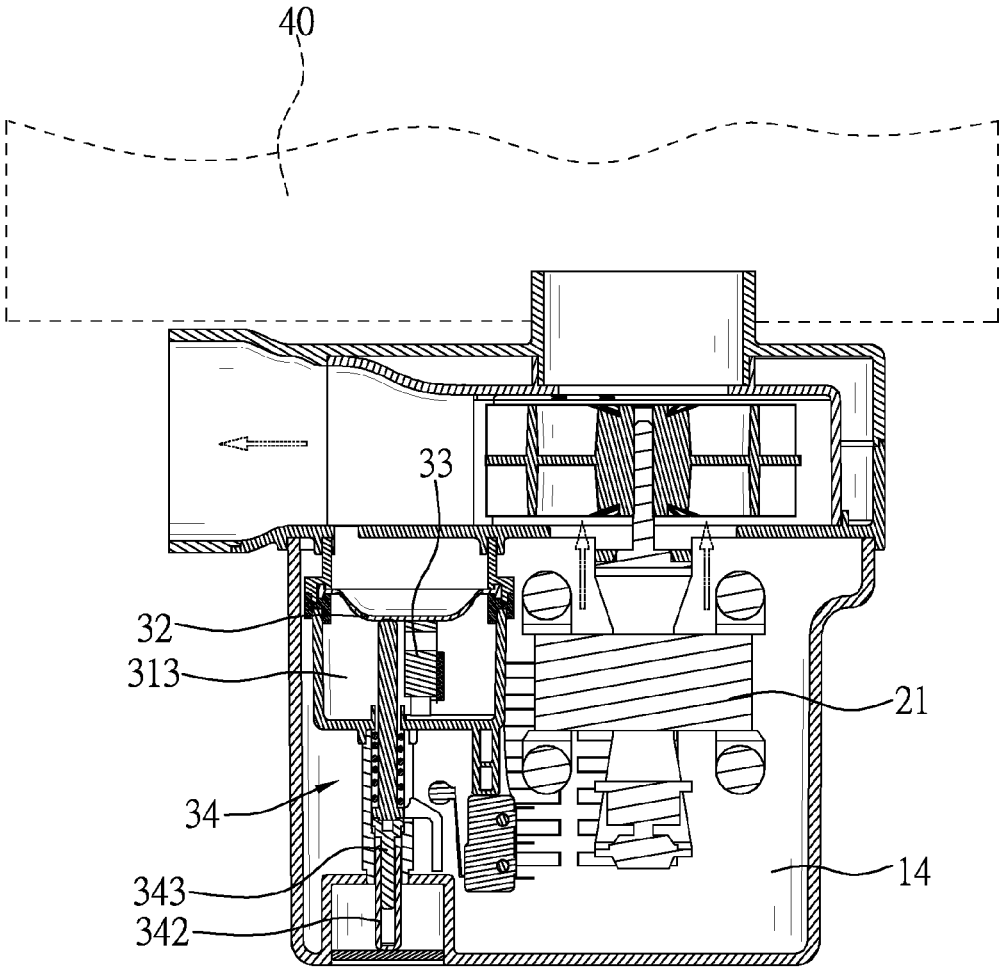
FIG. 14 is an operational side view in partial section of the auto-stop air pump in FIG. 1, showing the film becoming deformed downward in deflating work.

With reference to FIG. 12, when the air pump is operated for deflating, the main inlet 15 is connected to the inflatable article 40 and the outlet 16 communicates with the environment. With further reference to FIG. 13, the inflatable article 40 presses the top end 1821 of the pressing part 182 to drive the moving board 181 to move downward. The air vent 1811 misaligns with the auxiliary inlet 17 so the lower chamber 14 is sealed. The operation of starting the motor 21 in the deflating work is the same as that for the inflating work. The motor 21 operates and drives the dual-sided impeller 22 to rotate and the air inside the inflatable article 40 is deflated via the main inlet 15, the top side of the dual-sided impeller 22, the upper chamber 13 and the outlet 16 in sequence, or via the bottom side of the dual-sided impeller 22 via the annular channel 19 to flow out. Because diversion trenches 223 are formed on the two opposite sides of the dual-sided impeller 22, the air flowing through both two sides of the dual-sided impeller 22 can be formed into a fast airflow so the work can be more efficient. With reference to FIG. 14, when the deflating process is finished, the dual-sided impeller 22 will deflate the air inside the lower chamber 14 and the lower chamber 313 of the shell 31 so the pressure inside the lower chamber 14 and the lower chamber 313 gradually decreases. The film 32 becomes deformed downward and abuts the micro switch 33 so that the micro switch 33 is switched off and the motor 21 stops operating. Thus, the function of auto-stop in deflating work is achieved.

Figure 15:
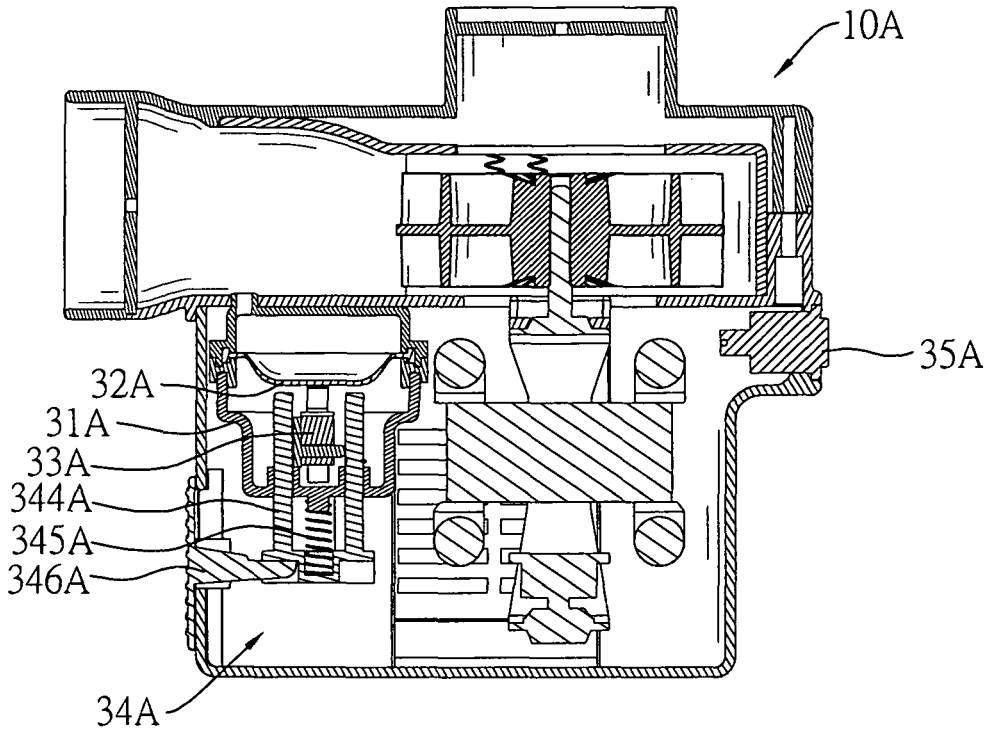
FIG. 15 is a side view in partial section of another embodiment of the auto-stop air pump in accordance with the present invention.

With reference to FIG. 15, in another embodiment, the master switch 35A is detached from the shell 31A and the actuating unit 34A is single-step controlled. The master switch 35A is mounted on the housing 10A. The actuating unit 34A has an abutting part 344A, a pressure spring 345A and a pushing part 346A. The abutting part 344A is mounted movably through the shell 31A. The pressure spring 345A is mounted under the shell 31A and has two ends. One end of the pressure spring 345A abuts the abutting part 344A. The other end of the pressure spring 345A abuts the shell 31A. The pushing part 346A is attached to the abutting part 344A and has a side mounted out of the housing 10A. In operation, the master switch 35A must be switched on first, the pushing part 346A is then pushed upward to drive the abutting part 344A to move upward and abut the film 32A so the micro switch 33A is switched on. Then the pushing part 346A is released and the pressure spring 345A provides a resilient force to push the abutting part 344A to the original position. When the film 32A becomes deformed downward by pressure and abuts the micro switch 33A, the micro switch 33A is switched off Thus, the function of auto-stop in work is achieved.

The air pump in accordance with the present invention can inflate or deflate the inflatable article 40 quickly and features automatic stop function so that the air pump stops automatically when an inflatable article is finished inflating or deflating by the air pump. Additionally, the air pump in accordance with the present invention is composed of fewer elements as compared with the conventional air pump so is simplified and increases production efficiency while reducing costs. Therefore, the air pump in accordance with the present invention is conveniently provided for application.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An auto-stop air pump comprising:

a housing having an upper chamber and a lower chamber communicating with each other via a communicating hole;

a main inlet and an outlet formed through the housing respectively and communicating with the upper chamber;

an auxiliary inlet formed through the housing and communicating with the lower chamber; and an air valve mounted in the housing adjacent to the auxiliary inlet;

a blower mounted in the housing and having a motor mounted in the lower chamber of the housing and having a shaft; and a dual-sided impeller mounted in the upper chamber of the housing , mounted securely around the shaft of the motor and having a top side facing and corresponding to the main inlet of the housing;

a bottom side facing and corresponding to the communicating hole of the housing; and an annular side facing and corresponding to the outlet of the housing; and an auto-stop device mounted in the housing and having a shell having an upper chamber communicating with the upper chamber of the housing; and a lower chamber communicating with the lower chamber of the housing;

a deformable film mounted in the shell and separates the upper chamber and the lower chamber of the shell;

a micro switch mounted in the lower chamber of the shell and pressed by the film; and an actuating unit mounted movably through the shell and abutting the film.

2. The auto-stop air pump as claimed in claim 1, wherein the dual-sided impeller has a panel mounted securely on the shaft of the motor; and multiple blades formed perpendicularly on two opposite side surfaces of the panel.

3. The auto-stop air pump as claimed in claim 1, wherein the housing further has an annular channel defined around the dual-sided impeller and communicating with the main inlet and the communicating hole of the housing.

4. The auto-stop air pump as claimed in claim 1, wherein the shell of the auto-stop device further has an orifice, the lower chamber of the shell communicates with the lower chamber of the housing via the orifice.

5. The auto-stop air pump as claimed in claim 1, wherein the housing further has an aperture, the upper chamber of the shell communicates with the upper chamber of the housing via the aperture.

6. The auto-stop air pump as claimed in claim 1, wherein the air valve of the housing has a moving board having an air vent aligning with the auxiliary inlet of the housing.

7. The auto-stop air pump as claimed in claim 6, wherein the air valve of the housing further has a pressing part attached to the moving board and having a top end protruding out of the housing adjacent to the main inlet of the housing; and a return spring mounted under the pressing part and abuts the pressing part.

8. The auto-stop air pump as claimed in claim 1, wherein the actuating unit is two-step controlled and has a sleeve mounted securely under the shell and having an inner surface;

multiple ratchets formed around the inner surface of the sleeve; and multiple tracks formed separately between the ratchets of the sleeve;

a sliding part mounted movably through the sleeve and having a top end;

a bottom end protruding out of the sleeve;

a top end surface;

an outer surface;

multiple bosses protruding from and formed separately around the outer surface and the top end of the sliding part and respectively engaging the tracks of the sleeve; and multiple teeth formed around the top end surface of the sliding part;

a rotating part mounted rotatably through the sleeve and the sliding part and having a top end;

an outer surface; and multiple ribs protruding from and formed separately around the outer surface and the top end of the rotating part, respectively engaging the tracks of the sleeve and respectively abutting the bosses of the sliding part;

an abutting part mounted movably through the sleeve and having a bottom end abutting the rotating part;

an upper section protruding through the lower chamber of the shell; and a lower section; and a pressure spring mounted around the lower section of the abutting part and mounted in the sleeve and has two ends, one end abutting the abutting part and the other end abutting the shell.

9. The auto-stop air pump as claimed in claim 8, wherein the micro switch is normally opened.

10. The auto-stop air pump as claimed in claim 9, wherein the abutting part of the auto-stop device further has a block protruding from the bottom end of the abutting part; and the auto-stop device further has a master switch mounted on the shell near the block of the abutting part, being normally closed, and the master switch and the micro switch are connected to each other in series.

11. The auto-stop air pump as claimed in claim 1, wherein the actuating unit is single-step controlled and has an abutting part mounted movably through the shell;

a pressure spring mounted under the shell and having two ends, one end abutting the abutting part and the other end abutting the shell; and a pushing part attached to the abutting part and having a side mounted out of the housing.

12. The auto-stop air pump as claimed in claim 11, wherein the micro switch is normally opened.

13. The auto-stop air pump as claimed in claim 12, wherein the auto-stop device further has a master switch mounted on the housing.

* * * * *